US005279208A

United States Patent [19]

Kyrlin

[11] Patent Number: 5,279,208

[45] Date of Patent: Jan. 18, 1994

[54] ROTARY RECIPROCATING ENGINE WITH SYNCHRONIZATION MECHANISM

[76] Inventor: Uno Kyrlin, Klintåasgatan 1, 422 44, Hisings Backa, Sweden

[21] Appl. No.: 938,121

[22] PCT Filed: Apr. 12, 1990

[86] PCT No.: PCT/SE90/00251

§ 371 Date: Oct. 8, 1992

§ 102(e) Date: Oct. 8, 1992

[87] PCT Pub. No.: WO91/16540

PCT Pub. Date: Oct. 31, 1991

[51] Int. Cl.[5] ..... F04B 1/04

[52] U.S. Cl. ..... 92/72; 417/273; 91/497

[58] Field of Search ..... 417/219, 273; 92/12.1, 92/72; 91/497, 498, 491, 493

[56] References Cited

U.S. PATENT DOCUMENTS 4,697,991 10/1987 Tsukahara ..... 417/219

FOREIGN PATENT DOCUMENTS 81789 6/1915 Fed. Rep. of Germany ..... 91/497
863577 7/1949 Fed. Rep. of Germany ..... 91/497
245783 8/1947 Switzerland ..... 91/498
248076 2/1948 Switzerland ..... 91/498

*Primary Examiner*—Edward K. Look
*Assistant Examiner*—Roland G. McAndrews, Jr.
*Attorney, Agent, or Firm*—Marshall, O'Toole, Gerstein, Murray & Borun

[57] ABSTRACT

A rotary reciprocating engine has a rotating center shaft and a rotating outer rim with a rotational eccentricity in relation to the center shaft. The engine has a synchronization mechanism including a synchronizing hub, a guide rail, one cam member fitted to the center shaft, and another cam member fitted to the outer rim. The synchronization mechanism has the same rotational eccentricity in relation to the center shaft as the outer rim, but the rotational axes of the synchronization mechanism and the outer rim are on opposite sides of the rotational axis of the center shaft. The synchronization mechanism restrictively guides rotation of the center shaft and the outer rim, and transfers and balances the forces and moments generated by the pressure medium in the engine, leading to the pistons and cylinders being subjected to axially directed forces only and not moment transferring cross head forces.

1 Claim, 3 Drawing Sheets

Figure 2:
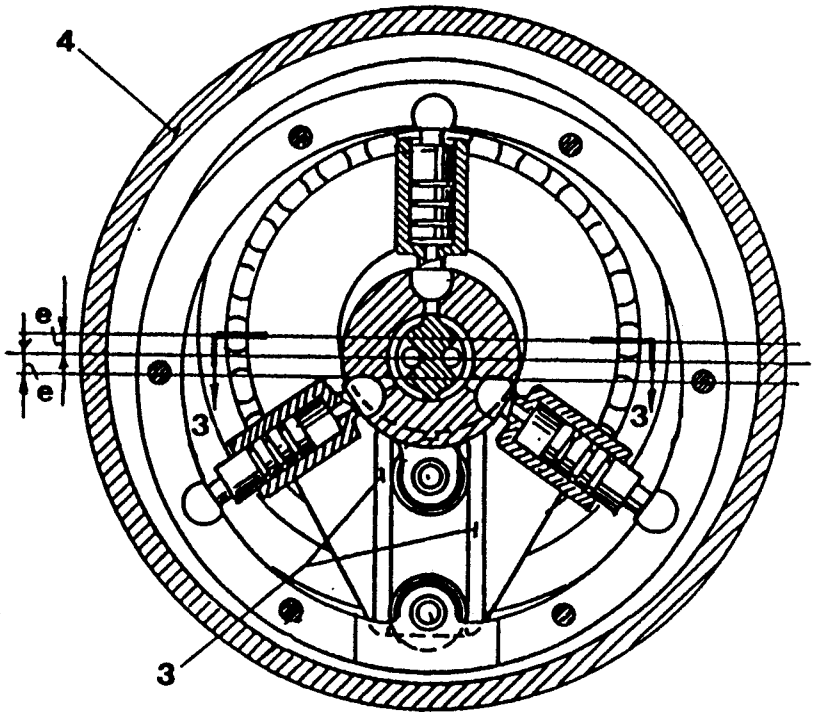

F
B
32
33
35
4
20
36
38
22
e
c
a
b
1
2
3
5
6
7
8
9
10
11
13
14
15
16
18
21
23
24
26
27
28
29
30
31
37
53

ROTARY RECIPROCATING ENGINE WITH SYNCHRONIZATION MECHANISM

The device is a radial reciprocating engine provided with a built in synchronizing mechanism, which is intended to be driven as pump or motor and which may be designed with a fixed or an infinitely adjustable displacement. By actuation of the synchronizing mechanism, both of the rotating main portions of the engine [the centre shaft 1 and the outer rim 2] are urged to rotate at a synchronous speed and the mechanism simultaneously causes; on one hand a transfer of the forces generated by the pressure medium and on the other hand a balancing by means of the force moment, which from the outside is supplied or led away through the shaft journal of the machine. In connection hereto is also obtained a relieving of the cross head forces on the pistons 11 and cylinders 10, fitted between the centre shaft 1 and the outer rim 2. The synchronizing mechanism consists of a synchronizing hub 3, supported thus that its centre of rotation coincides with the line c—c and being designed with a guide rail-provided control arm, which in combination with two cam rollers 24 and 23, affixed to the centre shaft 1 and to the outer rim 2 resp., causes a restricted rotation of these portions. The centre shaft 1, with the rotational centre a—a, is supported in fixed bearings in the machine frame. At distance e, on both sides of the line a—a are found the rotational centres b—b and c—c for the outer rim and for the synchronizing hub 3 resp. In machines of the type having an adjustable displacement a parallel displacement of these rotational centres is effected towards the line a—a with the result that the flow volume at first is reduced to 0 and thereupon, at continued adjustment, increases to the original value, but with a reversal of the flow direction.

The following drawings are attached hereto:

Drawing I shows a machine designed for constant displacement

Figure 1:
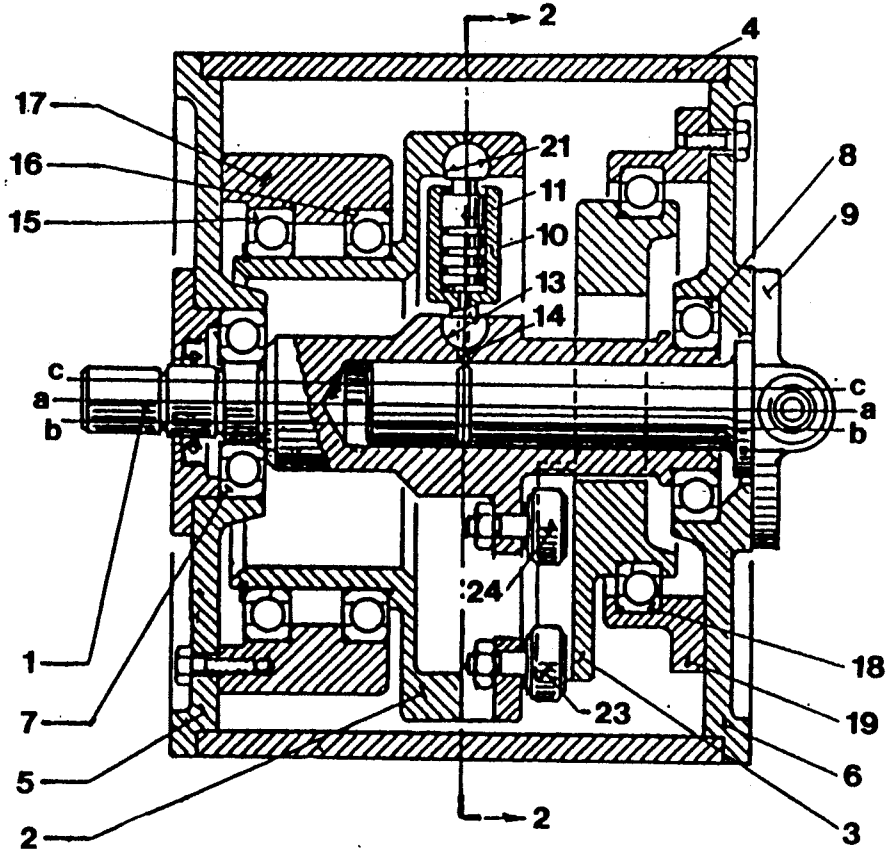

FIG. 1—longitudinal section

FIG. 2—cross section 2—2

Figure 3:
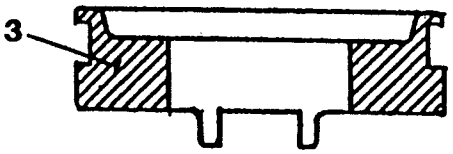

FIG. 3—section 3—3 of the synchronization hub

Drawing II shows a machine with adjustable displacement

Figures 4, 5, 6:
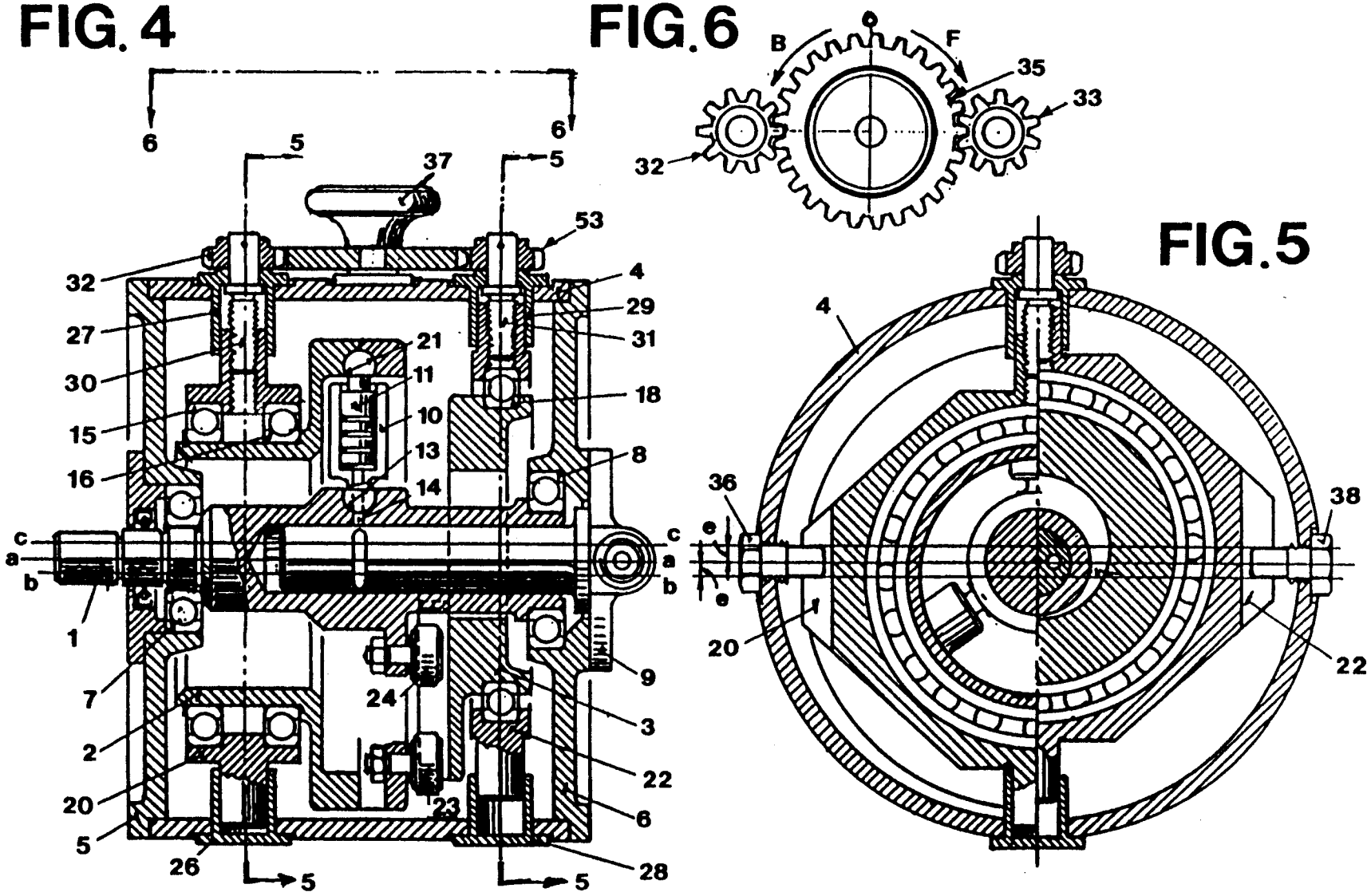

FIG. 4—longitudinal section

FIG. 5—two cross section 5—5

FIG. 6—external view of the adjustment apparatus

Drawing III shows three schematical sketches

Figure 7:
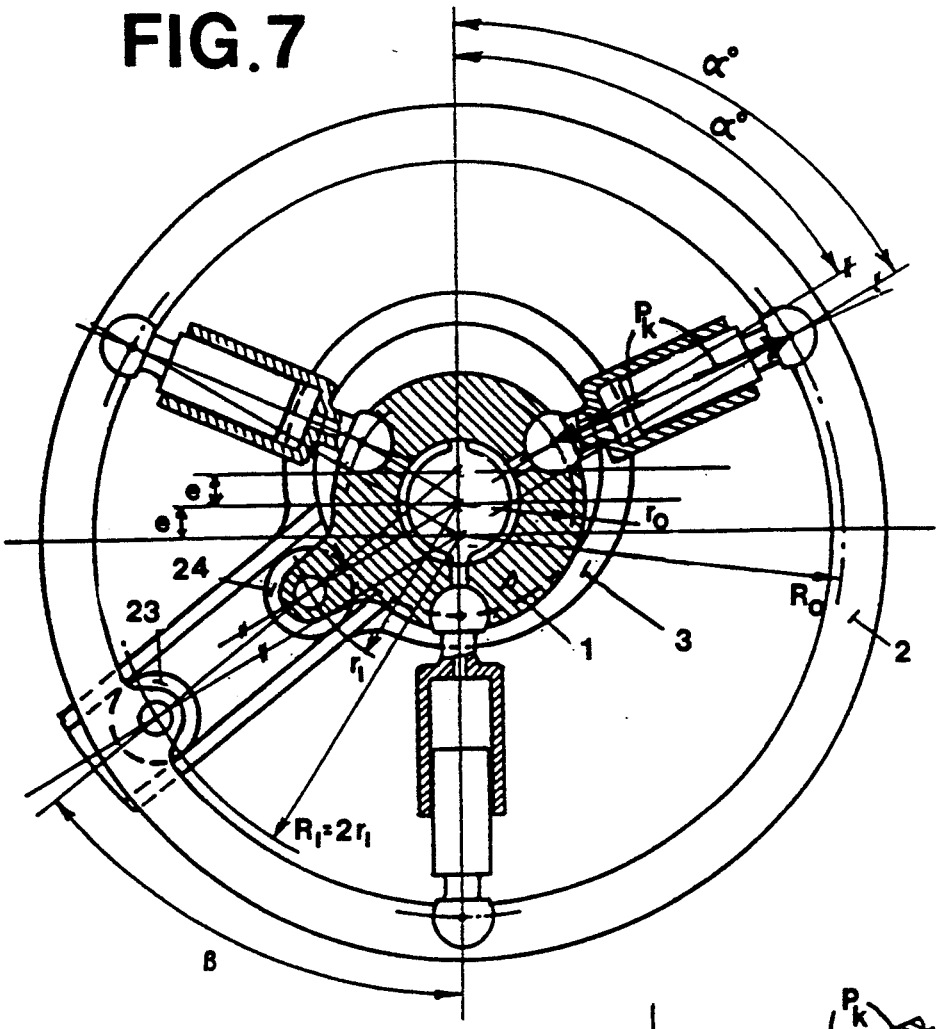

FIG. 7—simplification of section 2—2 to FIG. 2

Figure 8:
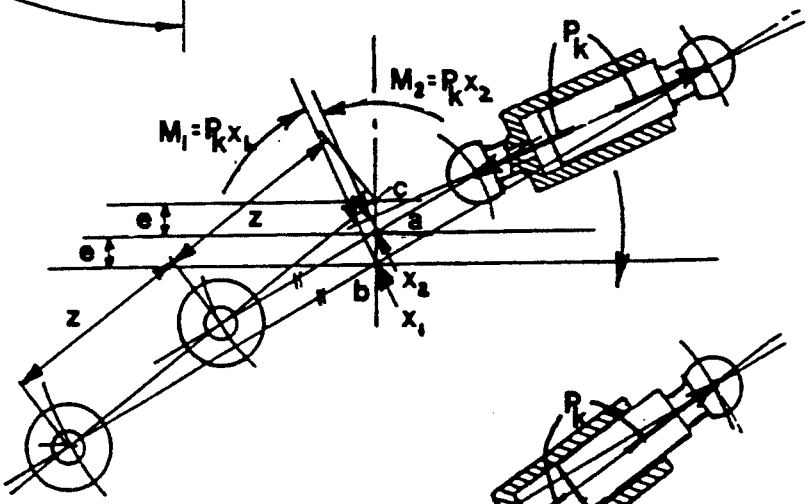
Figure 9:
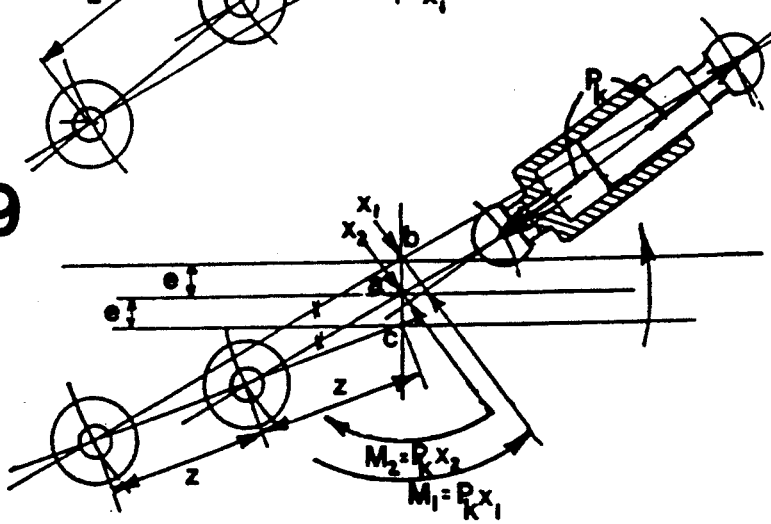

FIG. 8—load and moment distribution at an arbitrary and 9—angular rotation $\alpha°$ at forward and rearward position resp.

DRAWING I

In the machine with constant displacement is shown that the frame consists of a shell 4 with two bearing bracings 5 and 6 bolted thereto and having built in bearings 7 and 8 for the centre shaft 1, one end of which is shaped into a shaft journal for force transmission and with the opposite end thereof shaped to receive the feed slide 9. Externally the centre shaft in section d—d has a number of spherical borings 13 for fitting of the cylinders 10. From each boring there is a radially directed hole 14 for communication with the feed slide 9. The centre shaft is designed for receiving a cam roller 24 bolted thereto at a distance $r_1$ from the rotational centre (a—a).

The outer rim 2 is supported by two bearings 15 and 16, which with the bearing attachment 17 are mounted thus that the rotational centre b—b will become parallel to (a—a) at distance e from this. Furthermore the outer rim has internally a number of spherical borings 21 for fitting of pistons 11 and there is furthermore a cam roller 23 bolted thereto at the distance $R_1$ from the rotational centre (b—b).

The synchronizing hub 3 has a supporting bearing 18 built into the bearing attachment 19, which is mounted thus that the line c—c will become the centre of rotation. This line is parallel to and positioned at distance e from the rotational centre (a—a) of the centre shaft but at the opposite side as compared to the line (b—b).

DRAWING II

At the machine with adjustable displacement, some details are exchanged and redesigned and the adjustment means are furthermore added. The shell 4 has bores for guide bushings 26, 27, 28 and 29 and guide screws 36 and 38 for guiding the new bearing attachments 20 and 22. The bushing 27 is a guidance for an adjustment screw 30, which is arranged in threads in the bearing attachment 20, and which has a gear wheel 32 clamped thereto, and which receives its motion from a gear wheel 35 fitted to the adjustment hand wheel 37. The bearing attachment 22 for the synchronizing hub receives its motion in the same manner via the gear wheel 33 from the hand wheel 37, but with the intermediary of a left hand adjustment screw 31, for giving this attachment an opposed movement at adjustment.

DRAWING III

FIG. 7 is a schematic sketch of the cross section 2—2 shown in FIG. 2. The machine is operated as a motor with the "right-hand half" as pressure side and the rotating main parts, the centre shaft 1 and the outer rim 2, have been urged to complete the same rotational angle $\alpha°$ from the initial position. The restricted guiding is effected in that the cam rollers 23 and 24 are urged by the guide rails of the synchronizing hub to take up such positions that their rotational centres together with the rotational centres of the main parts form two congruent triangles, all equally situated sides of which being parallel. Due to the pressure of the pressure medium exerted upon the cylinders 10 and the pistons 11 fitted between the centre shaft 1 and the outer rim 2, a piston force $P_k$ is generated, which with the perpendicular distance to the rotational centre b gives rise to a moment $P_k \cdot X_1$, which via the cam roller 23 and further via the synchronizing arm and via the cam roller 24 is transformed to an output torque at the centre shaft.

The reaction force $P_k$ acting in opposite direction upon the cylinder 10 causes with the momentum arm $X_2$, a counter clockwise torque $P_k X_2$, acting directly upon the rotational centre.

The final result is an output moment from the machine $M = P_k X_1 - P_2 X_2$, where the relation between the momentum arms is $X_1 : X_2 = R_0 : r_0$.

I claim:

1. A radial reciprocating engine, the frame of which is designed as a tubular shell with a bearing bracing bolted to each end thereof for receiving two rotating main portions of the engine, a centre shaft and an outer rim with a rotational eccentricity in relation to the centre shaft, which are both provided with spherical attachments for pressure medium actuated pistons and cylinders, characterized therein that on the opposite side of the rotational centre of the centre shaft in relation to that of the outer rim, but with adjustably the same rotational eccentricity in relation to the centre shaft as the outer rim, there is mounted a synchronizing hub provided with a guide rail, forming together with two cam rollers fitted to the centre shaft and to the outer rim respectively, a synchronizing mechanism, which besides restrictively guiding the rotation of the two main portions, transfers and balances the forces and moments generated by the pressure medium, thus leading to the different pairs of piston and cylinder being subjected to axially directed forces only and being entirely relieved from moment transferring cross head forces.

* * * * *